US012599207B2

(12) United States Patent
Luo

(10) Patent No.: US 12,599,207 B2
(45) Date of Patent: Apr. 14, 2026

(54) SLIDING SEAT ASSEMBLY FOR AN UMBRELLA

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 364 days.

(21) Appl. No.: 18/488,480

(22) Filed: Oct. 17, 2023

(65) Prior Publication Data

US 2024/0172847 A1 May 30, 2024

(30) Foreign Application Priority Data

Nov. 28, 2022 (CN) ..... 202211502349.6

(51) Int. Cl.
*A45B 23/00* (2006.01)
*A45B 25/06* (2006.01)

(52) U.S. Cl.
CPC ..... *A45B 25/06* (2013.01); *A45B 23/00* (2013.01); *A45B 2023/0037* (2013.01); *A45B 2200/1018* (2013.01)

(58) Field of Classification Search
CPC ..... A45B 2023/0031; A45B 2023/0037
See application file for complete search history.

(56) References Cited

U.S. PATENT DOCUMENTS 5,323,798 A * 6/1994 Yang ..... A45B 3/04 135/910
5,349,975 A * 9/1994 Valdner ..... A45B 3/00 135/33.7
5,584,564 A * 12/1996 Phyle ..... F21V 33/006 135/910
6,089,727 A * 7/2000 Wu ..... A45B 25/02 135/910
9,968,168 B2 * 5/2018 Ma ..... A45B 3/02
2007/0041175 A1 * 2/2007 Chang ..... A45B 23/00 135/910
2008/0105287 A1 * 5/2008 Huali ..... A45B 3/04 135/16
2010/0212705 A1 * 8/2010 Tung ..... A45B 23/00 135/20.1
2010/0307547 A1 * 12/2010 Li ..... A45B 3/04 135/16
2015/0216273 A1 * 8/2015 Akin ..... H02J 50/12 29/890.033
2023/0380557 A1 * 11/2023 Zhu ..... A45B 23/00
2024/0072357 A1 * 2/2024 Ma ..... A45B 25/10
2025/0248494 A1 * 8/2025 Ma ..... A45B 25/00

* cited by examiner

*Primary Examiner* — Noah Chandler Hawk
(74) *Attorney, Agent, or Firm* — Wang Law Firm, Inc.

(57) ABSTRACT

A sliding seat assembly for an umbrella, the umbrella having a column, a transverse rod having a lower end, a tilted rod, an umbrella frame, an upper nest connected to the transverse rod, and one or more electrical assemblies disposed on the umbrella frame; the sliding seat assembly has a sliding seat slidable along the column with a front end and a rear end, and a battery; the battery is removably connected to the sliding seat, the battery is electrically connected to the one or more electrical assemblies through a circuit assembly. By mounting the battery on the sliding seat, it is easy to operate, and it is very convenient to assemble and disassemble. Moreover, it is convenient for machining, and the production cost is low.

9 Claims, 7 Drawing Sheets

SLIDING SEAT ASSEMBLY FOR AN UMBRELLA

TECHNICAL FIELD OF THE INVENTION

The present invention relates to a field of outdoor umbrellas, and in particular to a sliding seat assembly for an umbrella.

BACKGROUND OF THE INVENTION

As a kind of outdoor leisure items, umbrellas are widely applied in squares, beaches, parks, gardens or similar places to shield an individual from sun, wind and rain. Most of the existing umbrellas in the market only have the function of shading from sun and rain, so the function is relatively simple. With the development of science and technology, it is dissatisfactory that the umbrellas only have the function of shading from sun and rain. For example, when the conventional umbrellas are used at night, the light is not clear and it is inconvenient to use. At present, there are also many umbrellas which can illuminate when the light is low.

After searching, a Chinese Patent CN206423677U (patent No.: CN201720012972.1) discloses an umbrella with LED lamps, comprising an umbrella body, wherein the umbrella further comprises: a plurality of first LED lamps which are mounted on canopy ribs, the canopy ribs being an umbrella framework closely attached to the umbrella canopy, a plurality of second LED lamps which are mounted on the support ribs, the support ribs being an umbrella framework supporting the canopy ribs, a control box which is fixed on a column, a first LED lamp control switch which is mounted on the panel of the control box, a second LED lamp control switch which is mounted on the panel of the control box, a controller which is fixed in an umbrella top box or the control box, a rechargeable battery which is fixed in the umbrella top box, and, a solar battery which is fixed on the top surface of the umbrella top box and connected to the rechargeable battery. The first LED lamp control switch and the second LED lamp control switch are connected to an input end of the controller respectively, the first LED lamps and the second LED lamps are connected to an output end of the controller respectively, and the rechargeable battery is connected to the controller. This umbrella is a solar umbrella which can provide lighting, but is complex in structure and high in cost.

The existing side-support umbrella generally comprises a base, a column, a transverse rod, a drawing rod and an umbrella frame; wherein a lower end of the transverse rod is arranged on the column, while an upper end thereof is connected to a top of the umbrella frame, a rear end of the drawing rod is mounted on a top of the column, while a front end thereof is connected to a middle portion of the transverse rod, the column is inserted into the base, the top of the umbrella frame is rotatably connected to the upper end of the transverse rod, a sliding seat is sleeved on the column, and, the lower end of the transverse rod is connected to the sliding seat. The sliding seat is slidable on the column to control the folding or unfolding of the umbrella frame. At present, the battery for supplying power is mostly mounted on the tray, so it is very inconvenient to assemble or disassemble.

SUMMARY OF THE INVENTION

It is an object of the present invention to provide a sliding seat assembly for an umbrella, which is simple in structure and convenient for battery assembling or disassembling.

For achieving the above object, the sliding seat assembly for an umbrella comprises a column, a transverse rod having a lower end, a tilted rod, an umbrella frame, an upper nest connected to the transverse rod, and one or more electrical assemblies disposed on the umbrella frame; the sliding seat assembly comprising a sliding seat slidable along the column with a front end and a rear end, and a battery; wherein, the battery is removably connected to the sliding seat, the battery is electrically connected to the one or more electrical assemblies through a circuit assembly.

As an improvement, the sliding seat has a transverse rod mounting seat at an upper portion of the front end of the sliding seat for a bottom of the transverse rod being connected thereto; the battery is connected to the sliding seat below the transverse rod mounting seat, or the battery is connected to a side wall of the sliding seat adjacent to the transverse rod mounting seat.

Preferably, when the battery is connected to the sliding seat, the sliding seat has a battery chamber at the front end of the sliding seat for receiving the battery; a fixation block having a bottom surface is removably connected to the sliding seat located at a bottom of the battery for positioning the battery after the battery is inserted into the battery chamber, a bottom surface of the fixation block is flush with the sliding seat.

Preferably, the circuit assembly has a wire with two ends and a patch board mounted on the upper nest, the sliding seat has a through hole inside the sliding seat and between the battery chamber and the transverse rod mounting seat for allowing the wire to pass through; one end of the wire is electrically connected to the battery, the other end thereof passes through the through hole of the sliding seat and the hollow transverse rod to electrically connect to the patch board, and the one or more electrical assemblies are electrically connected to the patch board.

Preferably, each electrical assembly comprises a light strip connected to the umbrella frame and a plug connected to the light strip, the light strip is electrically connected to the patch board through the plug.

As an improvement, when the battery is connected to the side wall of the sliding seat, a battery mounting seat for receiving the battery is connected to the side wall of the front end of the sliding seat, the battery mounting seat has a connector being respectively electrically connected to the battery and the circuit assembly; and the battery has a battery connector on a back surface of the battery for connecting to the battery mounting seat and electrically connected to the connector.

Preferably, the battery connector comprises two vertical insertion grooves for receiving the connector on the back surface of the battery, a slide fastener below the two insertion grooves on the back surface of the battery, and an unlock button; the battery mounting seat has a clamping slot for receiving the slide fastener, so that the battery is removably connected to the clamping slot of the battery mounting seat, the unlock button, being capable of driving the slide fastener to move downward to separate from the clamping slot, is arranged on the back surface of the battery below the slide fastener.

Preferably, the circuit assembly has a wire with two ends and a patch board mounted on the upper nest, the sliding seat has a through hole above the battery chamber for allowing the wire to pass through; one end of the wire is electrically connected to the battery, the other end thereof passes through the through hole of the sliding seat and the hollow transverse rod to electrically connect to the patch board, and the one or more electrical assemblies are electrically connected to the patch board.

Preferably, each electrical assembly comprises a light strip connected to the umbrella frame and a plug connected to the light strip, the light strip is electrically connected to the patch board through the plug.

Preferably, the sliding seat is composed of a left half sliding seat and a right half sliding seat connected to each other, the sliding seat has a vertical hole for allowing the column to pass through, the sliding seat has a handle portion at the rear end of the sliding seat; a rack is arranged on a rear surface of the column, and, a button buckle engaged with the rack for positioning the sliding seat is arranged on the handle portion.

Preferably, a wireless control system is connected to the circuit assembly, and the electrical assembly is controlled through a remote controller and the wireless control system.

Compared with the prior art, the present invention has the following advantages. By mounting the battery in the sliding seat or on the side face of the sliding seat, the electrical assembly can be powered on to provide lighting, and the battery is easily disassembled, so that it is convenient to replace the battery. In addition, by using wireless control, it is easy to operate. The present invention is simple and rational in structure. By mounting the battery on the sliding seat, it is easy to operate, and it is very convenient to assemble and disassemble. Moreover, it is convenient for manufacturing, and the productive cost is low.

DETAILED DESCRIPTION OF THE INVENTION

The present invention will be further described below in detail by embodiments with reference to the accompanying drawings.

Embodiment 1

Figure 1:
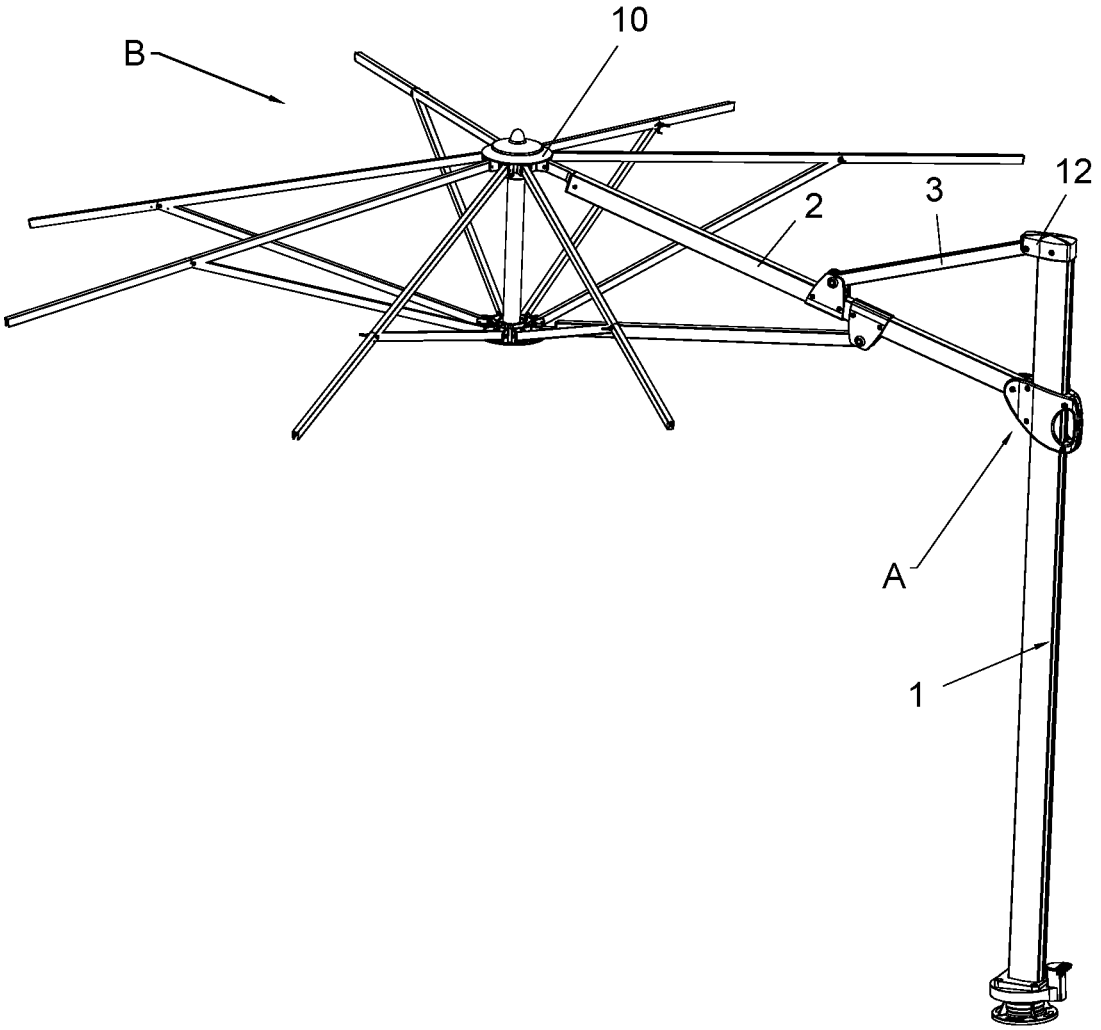
FIG. 1 is a perspective view of an umbrella according to Embodiment 1 of the present invention.
Figure 2:
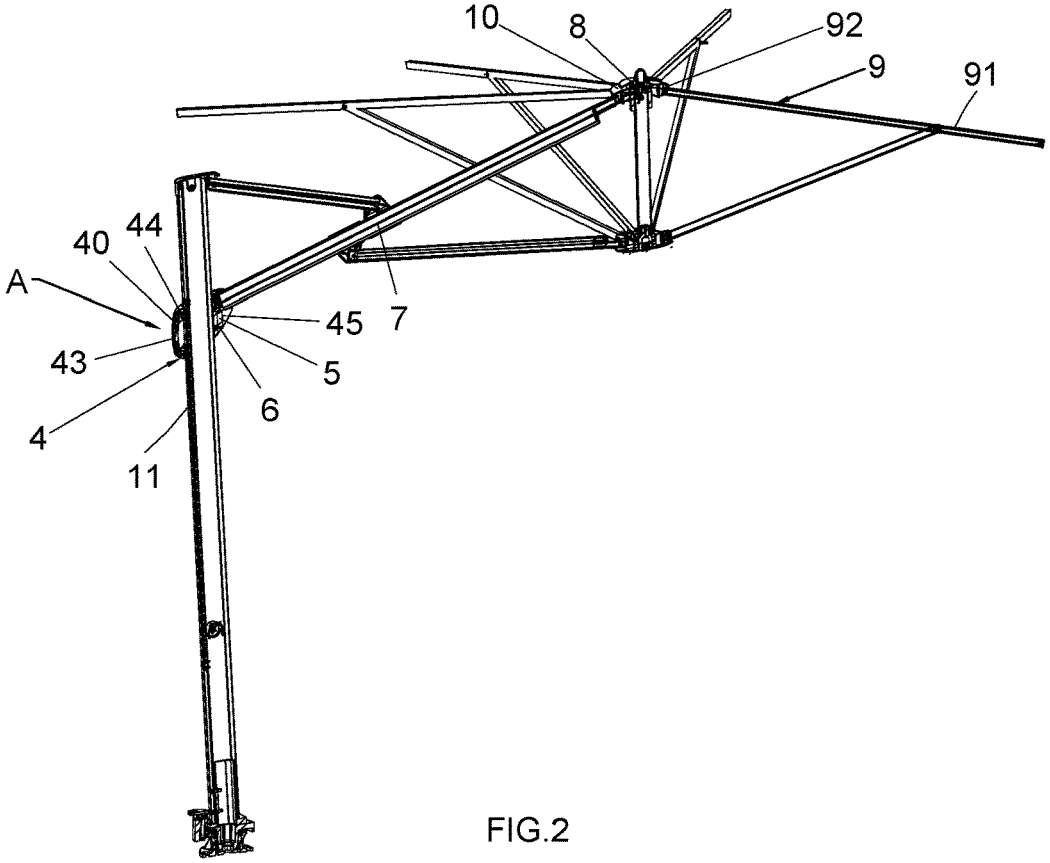
FIG. 2 is a perspective view of the umbrella with partial section according to Embodiment 1 of the present invention.
Figure 3:
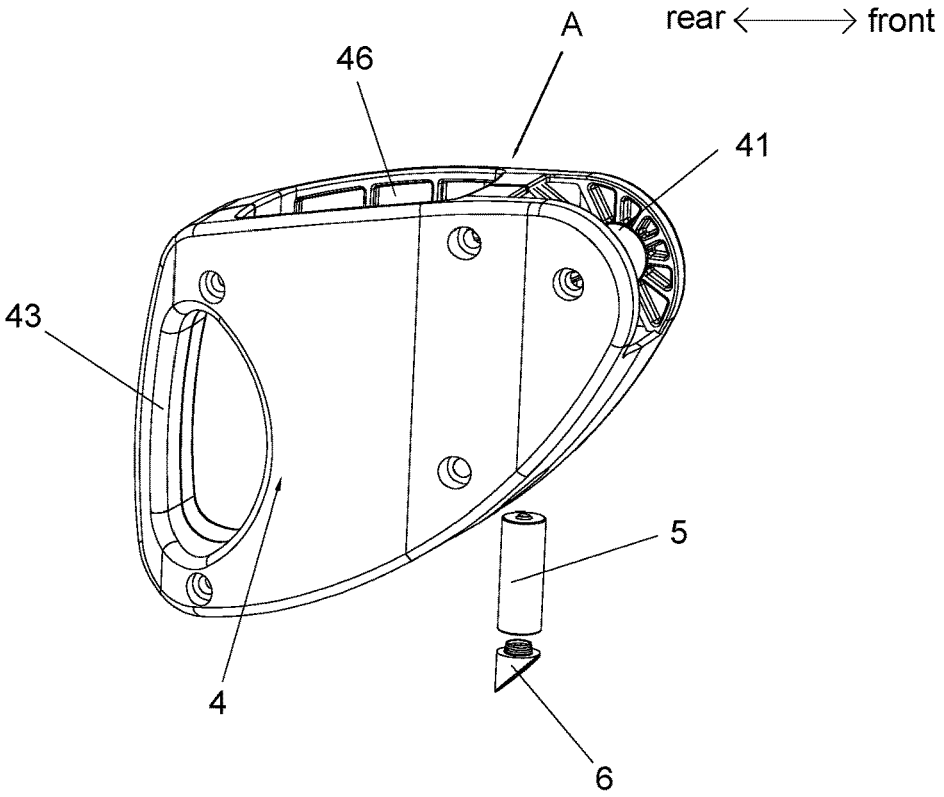
FIG. 3 is a perspective view of a sliding seat assembly according to Embodiment 1 of the present invention.
Figure 4:
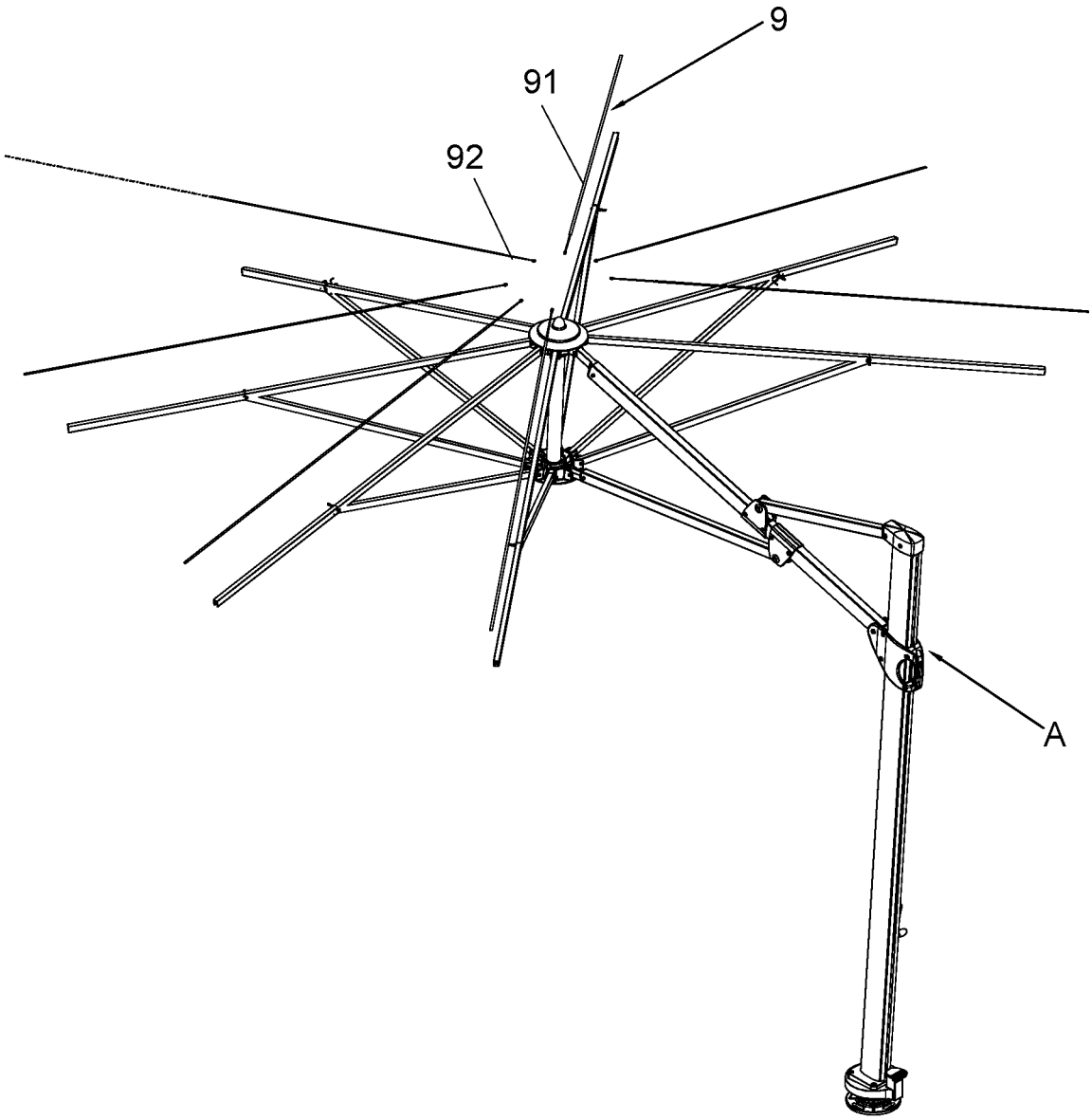
FIG. 4 is an exploded view of the umbrella according to Embodiment 1 of the present invention.

FIGS. 1-4 show a first embodiment of the sliding seat assembly for an umbrella. The umbrella comprises a column 1 having a top, a transverse rod 2 having an upper end, a middle portion and a lower end and, a tilted rod 3 having a front end and a rear end and an umbrella frame B having a top. The lower end of the transverse rod 2 is arranged on the column 1 to rotatably connect to the sliding seat assembly A, while the upper end thereof is rotatably connected to an upper nest 10 on the top of the umbrella frame B. The rear end of the tilted rod 3 is connected to the top of the column 1 and rotatably connected to a top jacket 12 of the column 1, while the front end thereof is rotatably connected to the middle portion of the transverse rod 2. The sliding seat assembly A comprises a sliding seat 4 slidable along the column 1 with a front end and a rear end, and a battery 5, the battery 5 is removably connected to the sliding seat 4, the battery 5 is electrically connected to the plurality of electrical assemblies 9 through a circuit assembly.

Specifically, the sliding seat 4 has a transverse rod mounting seat 41 at an upper portion of the front end of the sliding seat 4 for a bottom of the transverse rod 2 being connected thereto; the sliding seat 4 has a battery chamber 45 at the front end of the sliding seat 4 below the transverse rod mounting seat 41 for receiving the battery 5; a fixation block 6 having a bottom surface is removably connected to the sliding seat 4 located at a bottom of the battery 5 for positioning the battery 5 after the battery 5 is inserted into the battery chamber 45, a bottom surface of the fixation block 6 is flush with a bottom surface of the sliding seat 4. The fixation block 6 and the sliding seat 4 may be fixed by threads, or by buckling, etc. The circuit assembly has a wire 7 with two ends and a patch board 8 mounted on the upper nest 10, the sliding seat 4 has a through hole inside the sliding seat 4 and between the battery chamber 45 and the transverse rod mounting seat 41 for allowing the wire 7 to pass through; one end of the wire 7 is electrically connected to the battery 5, the other end thereof passes through the through hole of the sliding seat 4 and the hollow transverse rod 2 to electrically connect to the patch board 8. Each electrical assembly 9 comprises a light strip 91 connected to the umbrella frame B and a plug 92 connected to the light strip 91, the light strip 91 is electrically connected to the patch board 8 through the plug 92.

The sliding seat 4 is composed of a left half sliding seat and a right half sliding seat connected to each other, the sliding seat 4 has a vertical hole 44 for allowing the column 1 to pass through, the sliding seat 4 has a handle portion 43 at the rear end of the sliding seat 4; a rack 11 is arranged on a rear surface of the column 1, a idler wheel 44 engaged with the rack 11 and supporting a buckle is arranged in the sliding seat 4, and, a button buckle 40 engaged with the rack 11 for positioning the sliding seat 4 is arranged on the handle portion 43. The button is hinged to the handle and has a reset spring, and the button is rotatably connected to a rear end of the buckle.

The internal structure and positioning principle of the sliding seat 4 and the mounting manner of the light strip 9 are the same as those in the prior art and will not be specifically described here.

The circuit assembly is connected to a wireless control system, and the electrical assembly 9 is controlled through a remote controller and the wireless control system.

When it is necessary to replace the battery 5, the battery 5 can be taken out and replaced by disassembling the fixation block 6, which is very convenient.

When in use, the battery 5 is mounted in the sliding seat 4, and the electric energy can be transmitted to the light strip 91 through the wire 7 and the patch board 8, so that the light strip 91 is lighted, thereby realizing lighting.

Embodiment 2

Figure 5:
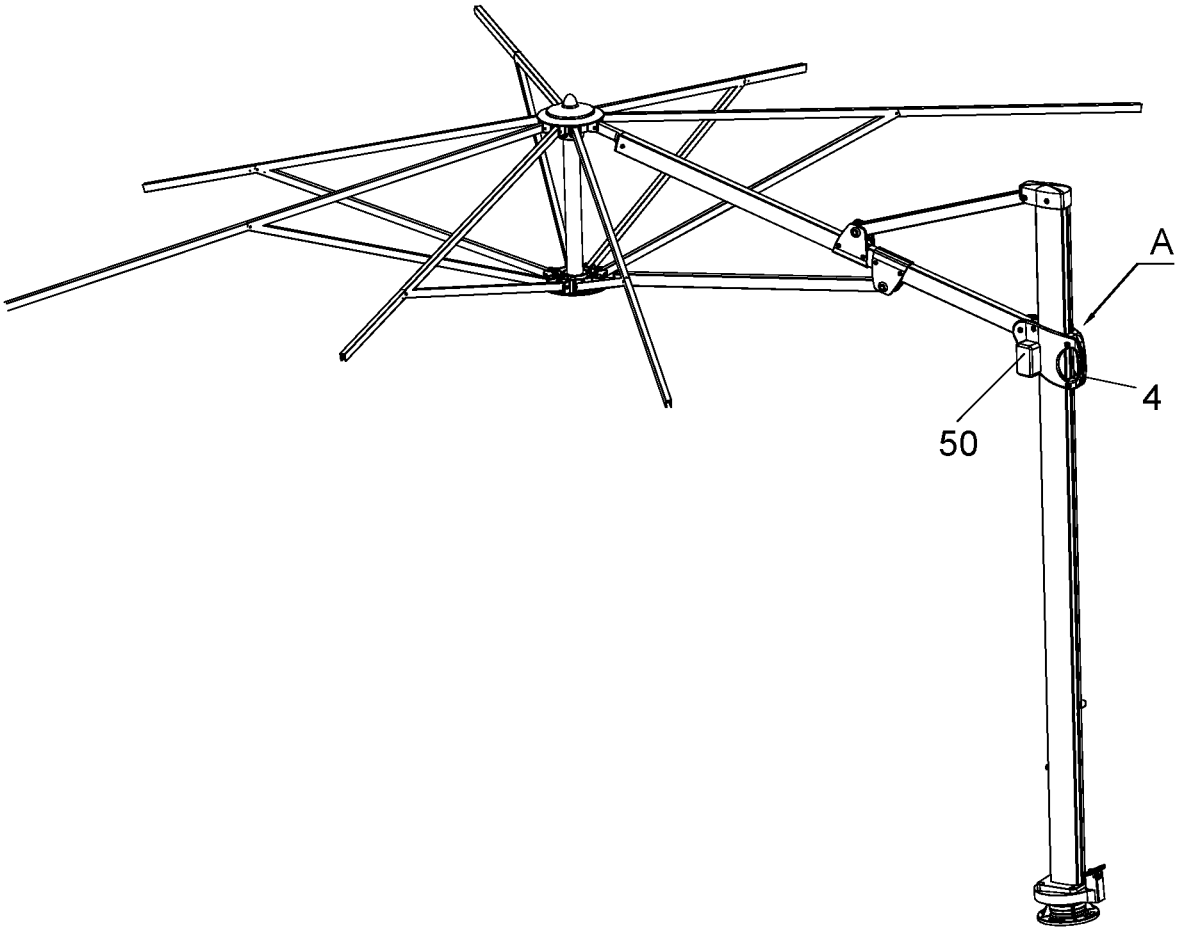
FIG. 5 is a perspective view of an umbrella according to Embodiment 2 of the present invention.
Figure 6:
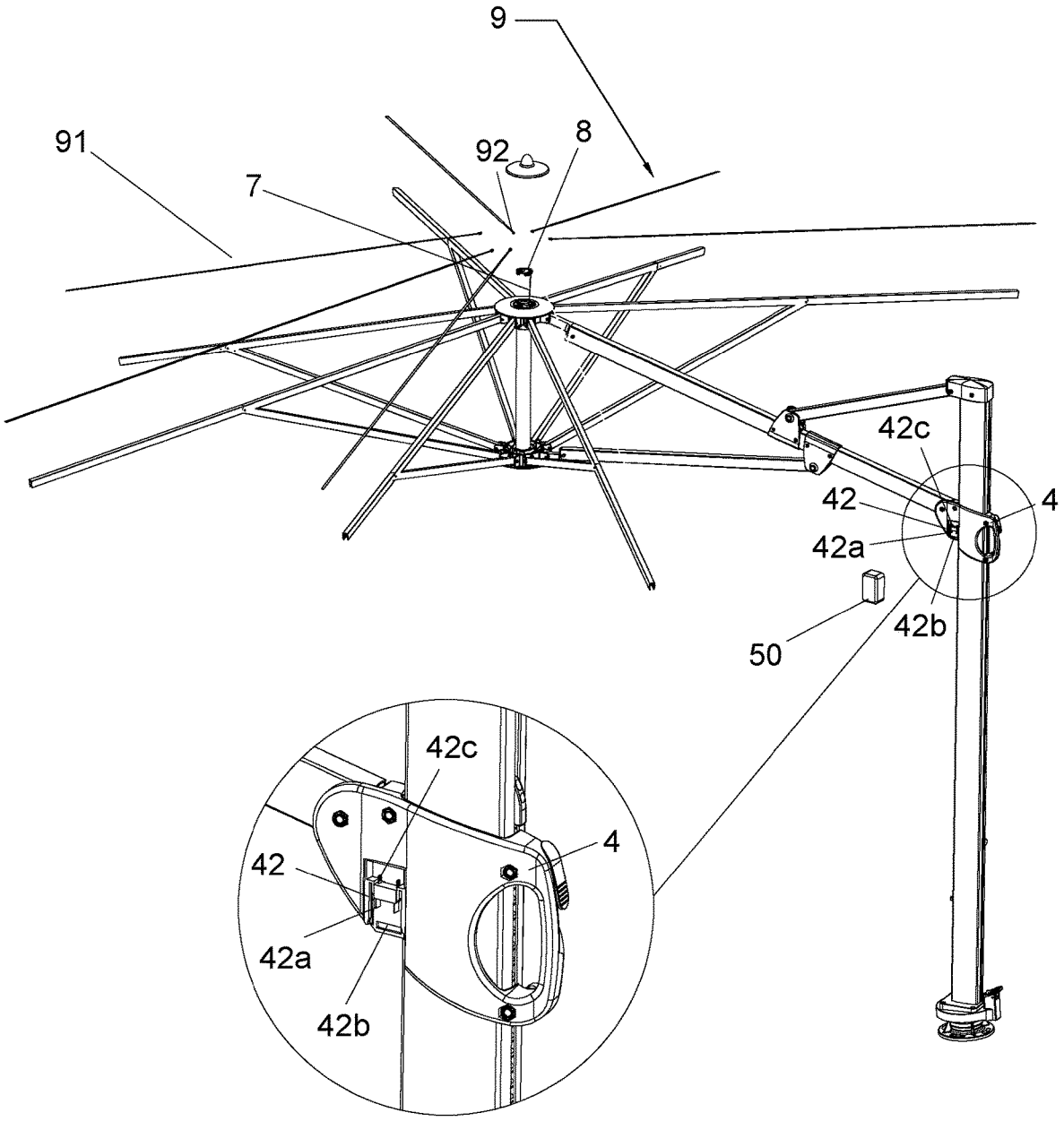
FIG. 6 is an exploded view of the umbrella according to Embodiment 2 of the present invention.
Figure 7:
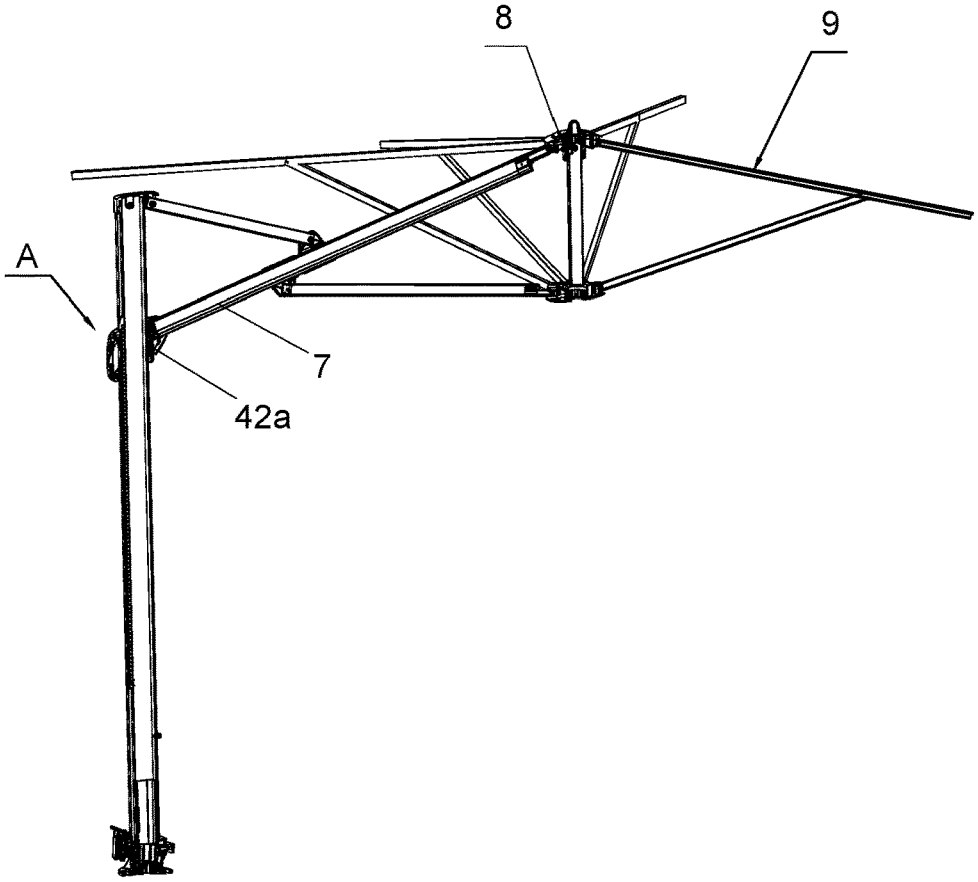
FIG. 7 is a perspective view of the umbrella with partial section according to Embodiment 2 of the present invention.
Figure 8:
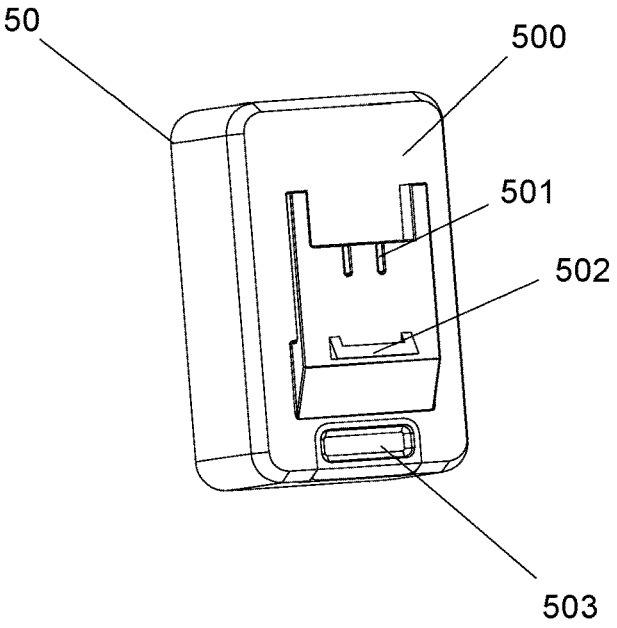
FIG. 8 is a perspective view of a sliding seat assembly according to Embodiment 2 of the present invention.
Figure 9:
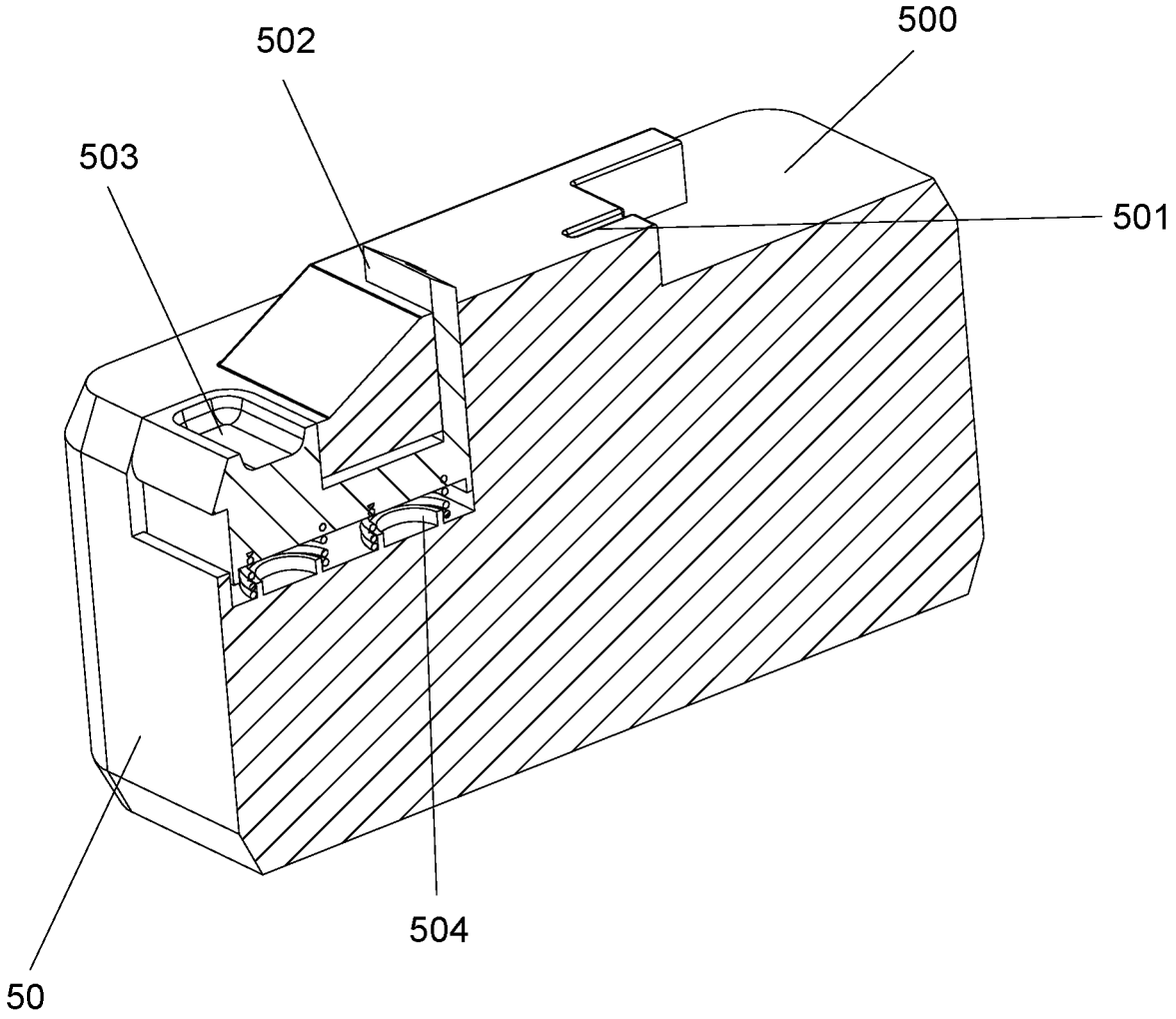
FIG. 9 is a sectional view of a storage battery assembly according to Embodiment 2 of the present invention.

FIGS. 5-8 show a second embodiment of the sliding seat assembly for an umbrella. The sliding seat assembly A comprises a sliding seat 4 and a storage battery 50 (a specific type of the battery) with a rectangular cross-section. The difference of this embodiment with Embodiment 1 is' as follows: the storage battery 50 is connected to a side wall of the sliding seat 4 adjacent to the transverse mounting seat 41. A battery mounting seat 42 for receiving the storage battery 50 is connected to the side wall of the front end of the sliding seat 4, the battery mounting seat 42 has a connector 42*a* being respectively electrically connected to the storage battery 50 and the circuit assembly; and the storage battery 50 has a battery connector 500 on a back surface of the storage battery 50 for connecting to the battery mounting seat 42 and electrically connected to the connector 42*a*. The battery connector 500 comprises two vertical insertion grooves 501 for receiving the connector 42*a* on the back surface of the storage battery 50, a slide fastener 502 below the two insertion grooves 501 on the back surface of the storage battery 50, and an unlock button 503; the battery mounting seat 42 has a clamping slot 42*b* for receiving the slide fastener 502, so that the battery is removably connected to the clamping slot 42*b* of the battery mounting seat 42; the unlock button 503, being capable of driving the slide fastener 502 to move downward to separate from the clamping slot 42*b*, is arranged on the back surface of the storage battery 50 below the slide fastener 502. Generally, the slide fastener 502 and the button 503 are connected to each other. A spring 504 resisted against the button 503 is arranged in the battery connector 500. When the button 503 is released, both the slide fastener 502 and the button 503 are bounced up.

The circuit assembly has a wire 7 with two ends and a patch board 8 mounted on the upper nest 10, the sliding seat 4 has a through hole 42 above the battery chamber 45 for allowing the wire 7 to pass through; one end of the wire 7 is electrically connected to the battery 5, the other end thereof passes through the through hole 42 of the sliding seat 4 and the hollow transverse rod 2 to electrically connect to the patch board 8, and the one or more electrical assemblies 9 are electrically connected to the patch board 8. Each electrical assembly 9 comprises a light strip 91 connected to the umbrella frame B and a plug 92 connected to the light strip 91, the light strip 91 is electrically connected to the patch board 8 through the plug 92.

The circuit assembly is connected to a wireless control system, and the electrical assembly 9 is controlled through a remote controller and the wireless control system.

When it is necessary to replace the storage battery 50, the storage battery 50 can be easily taken out and replaced by pressing down the button 503. During mounting the storage battery 50, the slide fastener 502 is aligned with and clamped into the clamping slot 42*b* of the mounting seat 42, thus the mounting of the storage battery 50 is finished.

When in use, the storage battery 50 is mounted on the side face of the sliding seat 4, and the electric energy can be transmitted to the light strip 91 through the wire 7 and the patch board 8, so that the light strip 91 is lighted, thereby realizing lighting.

The protection scope of the present invention is not limited to each embodiment described in this description. Any changes and replacements made based on the scope of the present invention patent and of the description shall be included in the scope of the present invention patent.

The invention claimed is:

1. A sliding seat assembly for an umbrella, the umbrella comprising a column, a transverse rod having a lower end, a tilted rod, an umbrella frame, an upper nest connected to the transverse rod, and one or more electrical assemblies disposed on the umbrella frame;

the sliding seat assembly comprising a sliding seat slidable along the column with a front end and a rear end, and a battery;

wherein, the battery is removably connected to the sliding seat, the battery is electrically connected to the one or more electrical assemblies through a circuit assembly;

the sliding seat has a transverse rod mounting seat at an upper portion of the front end of the sliding seat for a bottom of the transverse rod being connected thereto;

the battery is connected to the sliding seat below the transverse rod mounting seat, or the battery is connected to a side wall of the sliding seat adjacent to the transverse rod mounting seat;

when the battery is connected to the side wall of the sliding seat, a battery mounting seat for receiving the battery is connected to the side wall of the front end of the sliding seat, the battery mounting seat has a connector being respectively electrically connected to the battery and the circuit assembly;

and the battery has a battery connector on a back surface of the battery for connecting to the battery mounting seat and electrically connected to the connector.

2. The sliding seat assembly of claim 1, wherein when the battery is connected to the sliding seat, the sliding seat has a battery chamber at the front end of the sliding seat for receiving the battery;

a fixation block having a bottom surface is removably connected to the sliding seat located at a bottom of the battery for positioning the battery after the battery is inserted into the battery chamber, a bottom surface of the fixation block is flush with the sliding seat.

3. The sliding seat assembly of claim 2, wherein the circuit assembly has a wire with two ends and a patch board mounted on the upper nest, the sliding seat has a through hole inside the sliding seat and between the battery chamber and the transverse rod mounting seat for allowing the wire to pass through;

one end of the wire is electrically connected to the battery, the other end thereof passes through the through hole of the sliding seat and the hollow transverse rod to electrically connect to the patch board, and the one or more electrical assemblies are electrically connected to the patch board.

4. The sliding seat assembly of claim 3, wherein each electrical assembly comprises a light strip connected to the umbrella frame and a plug connected to the light strip, the light strip is electrically connected to the patch board through the plug.

5. The sliding seat assembly of claim 1, wherein the battery connector comprises two vertical insertion grooves for receiving the connector on the back surface of the battery, a slide fastener below the two insertion grooves on the back surface of the battery, and an unlock button;

the battery mounting seat has a clamping slot for receiving the slide fastener, so that the battery is removably connected to the clamping slot of the battery mounting seat;

the unlock button, being capable of driving the slide fastener to move downward to separate from the clamping slot, is arranged on the back surface of the battery below the slide fastener.

6. The sliding seat assembly of claim 5, wherein the circuit assembly has a wire with two ends and a patch board mounted on the upper nest; the sliding seat has a through hole above the battery chamber for allowing the wire to pass through;

one end of the wire is electrically connected to the battery, the other end thereof passes through the through hole of the sliding seat and the hollow transverse rod to electrically connect to the patch board, and the one or more electrical assemblies are electrically connected to the patch board.

7. The sliding seat assembly of claim 6, wherein each electrical assembly comprises a light strip connected to the umbrella frame and a plug connected to the light strip, the light strip is electrically connected to the patch board through the plug.

8. The sliding seat assembly of claim 1, wherein the sliding seat is composed of a left half sliding seat and a right half sliding seat connected to each other, the sliding seat has a vertical hole for allowing the column to pass through, the sliding seat has a handle portion at the rear end of the sliding seat;

a rack is arranged on a rear surface of the column, and, a button buckle engaged with the rack for positioning the sliding seat is arranged on the handle portion.

9. The sliding seat assembly of claim 1, wherein a wireless control system is connected to the circuit assembly, and the electrical assembly is controlled through a remote controller and the wireless control system.

* * * * *